US006727843B1

(12) United States Patent
Hansen

(10) Patent No.: US 6,727,843 B1
(45) Date of Patent: Apr. 27, 2004

(54) METHOD AND ARRANGEMENT FOR DETERMINING THE ANGLE OF ROLL OF A LAUNCHABLE ROTATING BODY WHICH ROTATES IN ITS PATHS

(75) Inventor: Åke Hansen, Karlstad (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/111,165

(22) PCT Filed: Oct. 18, 2000

(86) PCT No.: PCT/SE00/02010

§ 371 (c)(1),
(2), (4) Date: Aug. 2, 2002

(87) PCT Pub. No.: WO01/29505

PCT Pub. Date: Apr. 26, 2001

(30) Foreign Application Priority Data

Oct. 20, 1999 (SE) ..... 9903779

(51) Int. Cl.[7] ..... G01C 1/00; F41G 7/30

(52) U.S. Cl. ..... 342/62; 342/61; 244/3.1; 244/3.15; 244/3.21; 244/3.23

(58) Field of Search ..... 342/27, 28, 59, 342/61–65, 104, 105, 195, 5, 6, 7, 175, 188; 244/3.1–3.3

(56) References Cited

U.S. PATENT DOCUMENTS

| | | | | |
|---|---|---|---|---|
| 4,347,996 A | * | 9/1982 | Grosso | 244/3.16 |
| 4,750,689 A | | 6/1988 | Yff | |
| 5,163,637 A | | 11/1992 | Hansen | |
| 5,414,430 A | | 5/1995 | Hansen | |
| 5,425,514 A | * | 6/1995 | Grosso | 244/3.22 |
| 5,661,555 A | * | 8/1997 | Romer et al. | 244/3.13 X |
| 6,483,455 B2 | * | 11/2002 | Fleury et al. | 342/62 |

FOREIGN PATENT DOCUMENTS

| | | |
|---|---|---|
| EP | 0341772 A1 | 11/1989 |
| GB | 2301724 A | 11/1996 |

* cited by examiner

*Primary Examiner*—Bernarr E. Gregory
(74) *Attorney, Agent, or Firm*—Connolly Bove Lodge & Hutz LLP; Larry J. Hume

(57) ABSTRACT

The present invention concerns a method and an arrangement for determining the angle of roll of a launchable body (4) which rotates in its path. The launchable body (4) can consist of a rotating projectile, shell, guided missile or the like, launchable from a launching device (1). According to the invention the transmitter antenna (3) and receiver antenna (5) are each designed with their sweeping beams (6, 9) directed essentially towards each other. By detecting the time the two beams (6, 9) coincide and the signal strength received in the receiver antenna, the angle of roll of the launchable body can be determined.

20 Claims, 3 Drawing Sheets

METHOD AND ARRANGEMENT FOR DETERMINING THE ANGLE OF ROLL OF A LAUNCHABLE ROTATING BODY WHICH ROTATES IN ITS PATHS

BACKGROUND OF THE INVENTION

This invention concerns a method of determining the angle of roll of a launchable body which rotates in its path, such as a rotating projectile, shell, guided missile or the like which is launched from a launching device, in which a transmitter with antenna arranged in connection with the launching device communicates with a receiver with antenna arranged in the launchable body. The invention also concerns an arrangement for determining the angle of roll of a launchable body which rotates in its path, such as a rotating projectile, shell, guided missile or the like, which is launched from a launching device, comprising a transmitter with antenna arranged in connection with the launching device and a receiver with antenna arranged in the launchable body.

Methods and arrangements for determining the angle of roll of rotating bodies in similar circumstances are already known. For example, we can refer to U.S. Pat. No. 4,750,689 and EP A1 341 772. Both these documents show embodiments for determining the angle of roll by the utilization of polarized waves which are detected by means of two so-called frame antennas arranged in the rotating body and turned through 90 degrees in relation to each other. This involves a relatively bulky antenna arrangement and among other things the possibility of locating parts of the antenna in the fins of the rotating body is discussed. Another known embodiment is described in our U.S. Pat. No. 5,414,430 and in this case a phase-modulated polarized carrier wave is transmitted from which the angle of roll can be determined in the receiver of the rotating body. According to another embodiment known through our U.S. Pat. No. 5,163,637 a transmitted long-wave signal and a transmitted microwave signal are used for the determination in the rotating body of its angle of roll. The embodiments according to these two last-mentioned patents also require relatively bulky antenna arrangements in the rotating body.

SUMMARY OF THE INVENTION

The present invention proposes another solution which like the embodiment according to our U.S. Pat. No. 5,414,430 utilizes only one signal, preferably within the microwave range, to determine the angle of roll. According to the invention sweeping beams are used. Both the transmitter antenna and the receiver antenna are designed with a sweeping beam. The beams coincide for a longer or shorter period of time depending upon whether the beams are sweeping with each other or towards each other. For each half revolution which the rotating body rotates, the beams change between sweeping towards each other and sweeping with each other. The rotation position is determined unambiguously by measuring the time when the beams coincide and the signal strength which is obtained during the periods of time when the beams coincide. The problem of determining unambiguously whether it is the first half or second half of a rotation revolution has a simple solution in that the beams have periods of coincidence of different lengths in the two halves of the rotation revolution. In order to determine the angle within a half revolution the signal strengths are studied which arise in the receiver antenna when the beams coincide.

The invention solves the problem of ambiguity while at the same time an easily locatable and compact antenna arrangement can be arranged in the rotating body. The principal characteristics of the method according to the invention are that the transmitter antenna and receiver antenna are each designed with their sweeping beams directed principally towards each other, that the beam of the transmitter antenna sweeps in a fixed plane relative to the launching device, that the beam of the receiver antenna sweeps in a fixed plane relative to the launchable body, that the time the two beams coincide is detected and that the signal strength during the time the beams coincide is recorded to create an imaginary rotation envelope and that the angle of roll is determined based on the measured times and created imaginary rotation envelope. The principal characteristics of the arrangement for determining the angle of roll are that the transmitter antenna and receiver antenna are designed with sweeping beams and that the receiver comprises devices for processing received signal information concerning time and signal strength during the time the sweeping beams coincide.

According to a suitable method the transmitter and receiver antennas are dimensioned to work within the millimeter wave range, preferably within the frequency range 35–45 GHz. The receiver antenna is advantageously constructed of electrically controllable antenna elements in the form of dipole slots. Such a receiver antenna is very suitable for the frequency range proposed above and is easy to house in the rear part of the rotating body.

In order to ensure good interaction between the sweeping beams it is proposed according to an advantageous method that the sweeping beam of the receiver antenna is kept zeroed during the moment of launching and that the time interval between the interceptions of the beam of the transmitter antenna with the zeroed beam of the receiver antenna is measured and that after the abovementioned measuring and based on the measurement result the sweep of the receiver antenna is started in order to intercept the transmitter's sweep at approximately 0 degrees.

Additional characteristics of the invention are apparent from the attached patent claims.

BRIEF DESCRIPTION OF THE DRAWINGS

The invention will be described in greater detail below in principle and in exemplified form with reference to the attached drawings, in which.

DETAILED DESCRIPTION OF THE INVENTION

Figure 1:
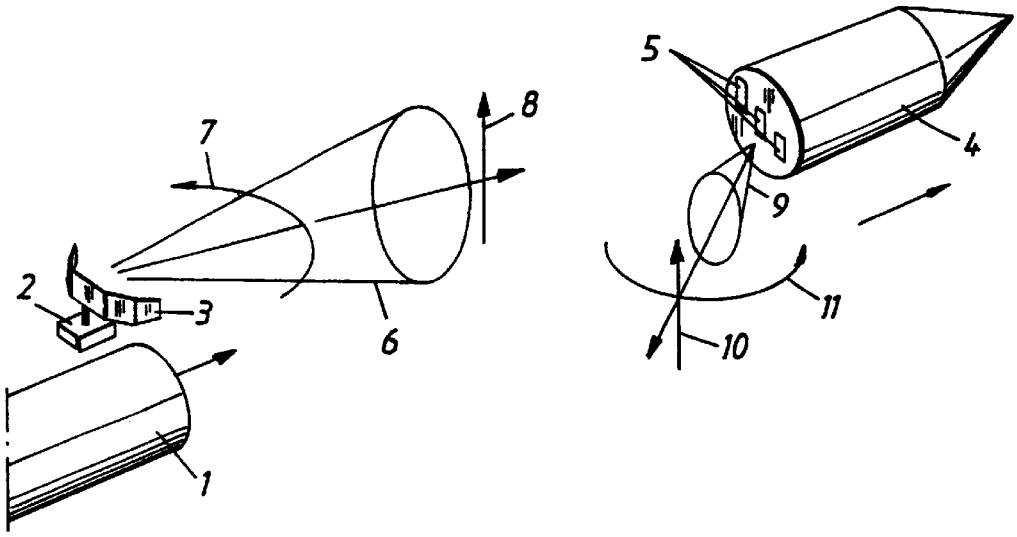
FIG. 1 shows an arrangement according to the invention for determining the angle of roll of a launchable body.

The arrangement shown in FIG. 1 comprises a launching device 1 shown diagrammatically as a gun barrel and can, for example, consist of a gun. In association with the launching device there is incorporated in the arrangement according to the invention a transmitter 2 with antenna 3. The transmitter 2 with antenna 3 is suitably incorporated in an existing radar in the launching unit, for example a millimeter wave radar. The antenna 3 and the launching device 1 are arranged in a suitable known way to be able to be turned vertically and horizontally. The launchable body is designated 4 and its rear part is provided with a receiver antenna 5. The antenna 5 is a so-called electrically controlled antenna and is constructed in the rear end of the launchable body 4. The antenna can advantageously consist of antenna slots milled out of metal, a so-called slot antenna, in which the metal can at the same time form part of the casing of the launchable body. By this means the launchable body is given a strong rear end. The electronic components are small and light and thus resistant to G-forces. The arrangement and in particular the antennas are designed preferably for the millimeter wave range and for example to work within the frequency range 35–45 GHz. The advantage of this frequency range is that the antenna can be made very small as the dipoles incorporated in it are only a few millimeters long. This frequency range also functions well in various kinds of weather conditions.

In the embodiment shown the beam of the antenna 3 designated by 6 sweeps horizontally with a suitable sweep angle from for example left to right, an arrow 7 indicating the return sweep. During the return sweep from right to left the transmitter/radar is kept turned off. The polarization direction of the E-field is shown by an arrow 8.

The antenna 5 in the launchable body forms a beam 9 which by electrical means sweeps from left to right with reference to the polarization direction 10 of the E-field. An arrow 11 indicates the return sweep and the signal during the return sweep is ignored.

Figure 2A:
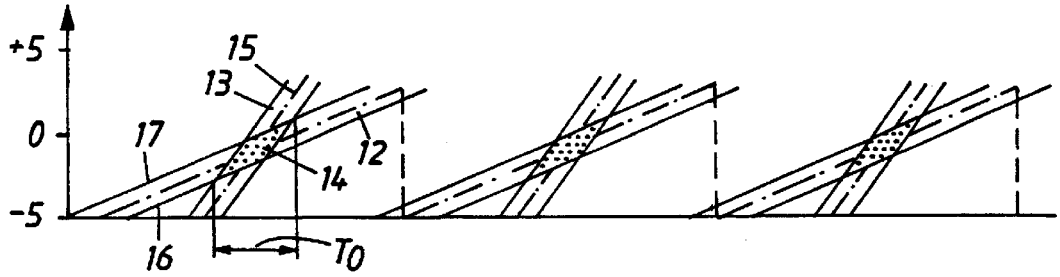
FIGS. 2*a* and 2*b* illustrate in diagrammatic form the sweep principle used according to the invention, showing the sweep angle as a function of time.
Figure 2B:
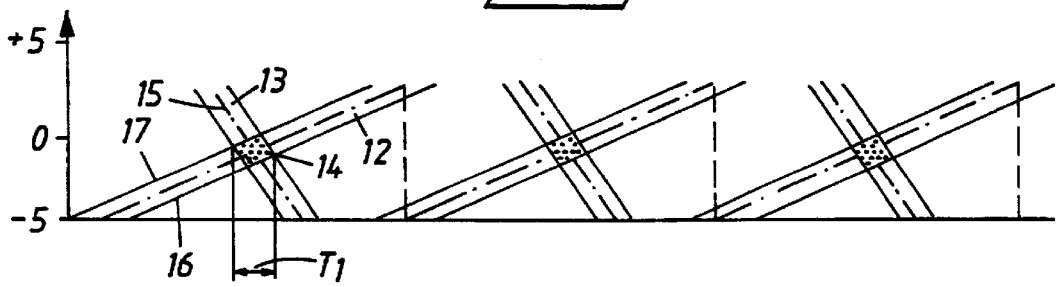

The interaction between transmitter sweep and receiver sweep is illustrated in FIG. 2*a* and FIG. 2*b*. A dotted line 15 marks the center line of the sweep, while solid lines 16, 17 on both sides of the dotted line show a specified power limit, for example −3 dB from the center line. During one half of one revolution of the rotation of the launchable body the beams sweep with each other. This is illustrated in FIG. 2*a* where the designation 12 refers to the transmitter sweep and the designation 13 refers to the receiver sweep. During the second half the beams sweep towards each other, which is shown in FIG. 2*b*. A dotted area 14 indicates where the transmitter and receiver beams coincide. From the diagram it can be seen that the beams coincide for a longer consecutive time when the beams sweep with each other than when the beams sweep towards each other, that is $T_0>T_1$. The receiver can thus detect signals for a longer time for each period of coincidence of the beams when the launchable body rotates within one half revolution than within the other. It is thus possible to determine easily which half of the revolution is concerned. From the diagrams in FIGS. 2*a* and 2*b* it can also be seen that in the illustrated example the receiver sweep has been allocated a shorter sweep time than the transmitter sweep.

Figure 3:
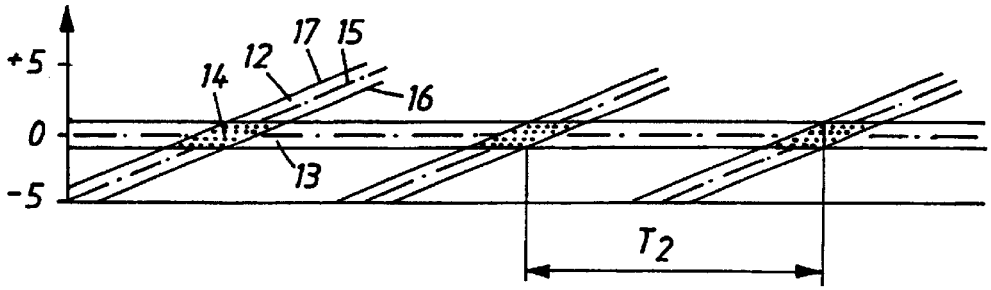
FIG. 3 illustrates in diagrammatic form the sweep principle used according to the invention, showing the sweep angle as a function of time at the moment of launching of the launchable body.

At the moment of launching the receiver's sweep is synchronized with the transmitter's by the sweep in the receiver being zeroed. This is shown diagrammatically in FIG. 3. The time interval $T_2$ between the sweeps' interceptions is measured and based on the time interval information the sweep in the receiver is started so that it intercepts the transmitter's sweep at approximately 0 degrees.

Figure 4B:
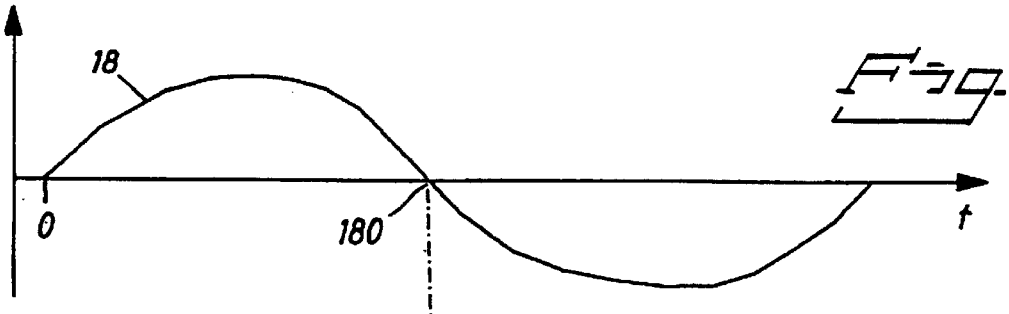
FIG. 4*b* shows an envelope curve for the received signal according to FIG. 4*a* as a function of angle.
Figure 4A:
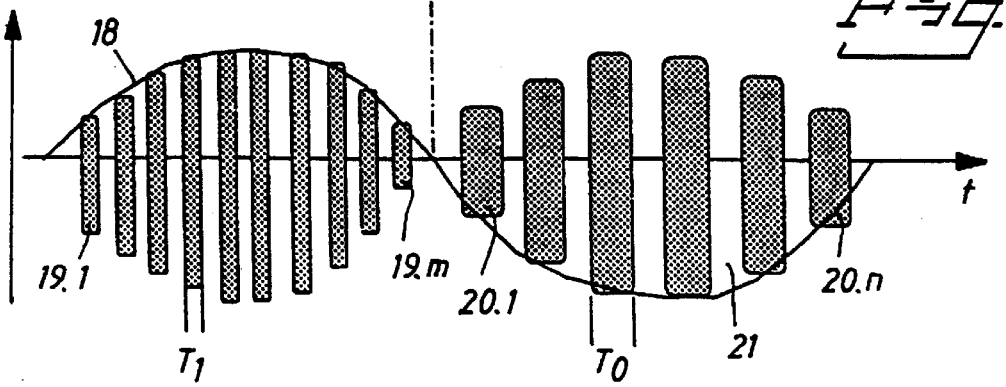
FIG. 4*a* shows diagrammatically an example of a signal received in the launchable body.

FIG. 4*a* shows an example of a signal received in the launchable body via the antenna 5 and an envelope curve 18 for this. The signal consists of bursts 19.1–19.m, 20.1–20.n separated by intervals 21 of just noise. The envelope curve's correspondences in angle are shown in FIG. 4*b* passing through zero at multiples of π. An example of how the receiver can be constructed diagrammatically is described in greater detail below with reference to FIG. 5. From FIGS. 4*a* and 4*b* it can be seen that during an interval from 0 to π the received signal increases in strength up to π/2 and then drops towards zero. The peak value corresponds to when the receiver beam's E-field coincides with the direction of the transmitter beam's E-field. This situation is shown in FIG. 1 and the E-field is here vertically oriented. At 0 and π radians the launchable body is in such a rotational position that the receiver beam's E-field is oriented at right angles to the transmitter beam's E-field and as a result no signal is obtained. During a second interval from π to 2π there is a corresponding increase and reduction in the signal strength. During the first interval, 0–π radians, the bursts 19.1–19.m have duration $T_1$ while the bursts 20.1–20.n during the second interval, π–2π radians, have duration To. The difference in duration between To and $T_1$ is due to the receiver sweep and the transmitter sweep moving with each other or towards each other and has already been discussed above. A way of determining the angle of roll within an interval 0–π is to record the envelope for the bursts of the received signal as a function of the angle. As the points 0, π, 2π, 3π, etc., are known and the launchable body can be assumed to rotate at an essentially even speed of rotation, the signal value can easily be determined for intermediate angles. Signal values with associated angle values can be stored in a table. The angle of roll within an interval can then be determined by reading off the angle for a particular burst value from the table.

Figure 5:
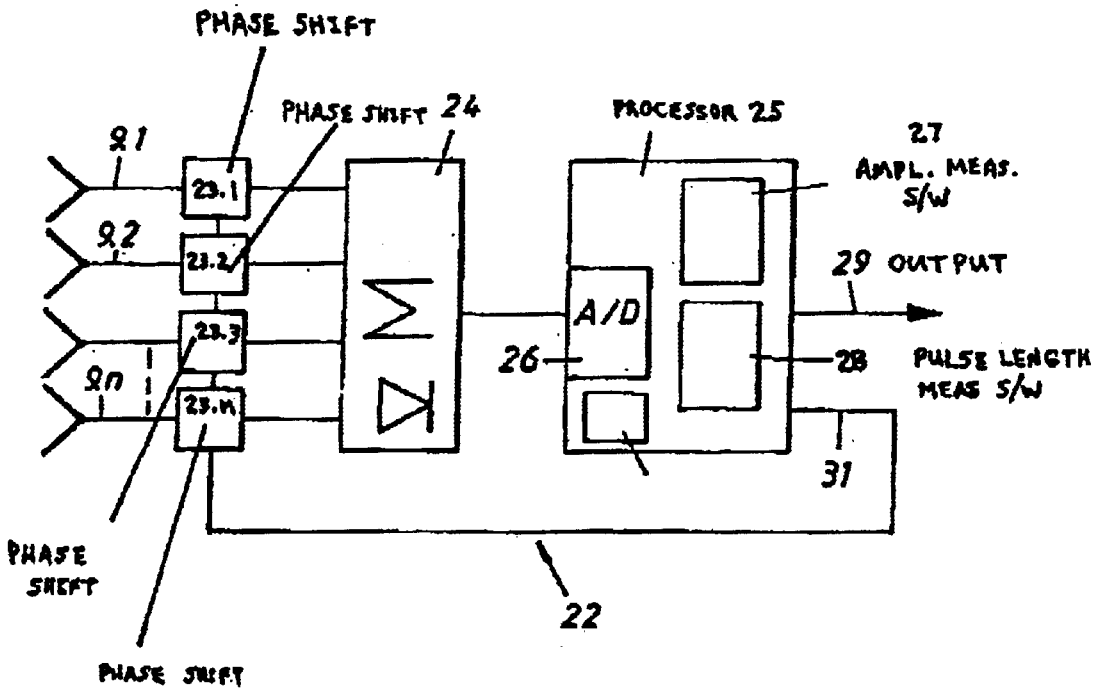
FIG. 5 shows a diagrammatic example of a receiver which can be incorporated in the rotating body.

The receiver 22 shown in FIG. 5 is connected on the input side to the electrically controllable antenna 9 in the form of a group antenna with a number of controllable antenna elements 9.1–9.n. Signals received on the antenna are passed to electrically controllable phase shifters 23.1–23.n before being passed to a summation point with envelope detector 24, which in turn is connected to a digital and central processor unit 25 with an A/D transducer 26 on the input side. Signal processing is carried out in the processor unit 25 in accordance with the principles outlined above based on incoming information. For this purpose the processor unit 25 contains among other things software for measuring amplitude 27 and software for measuring pulse length 28 and provides digital angle of roll information at its output 29. A block 30 designates the software which is incorporated in the processor unit 25 for controlling the beams of the group antenna 9 via an output 31.

The invention is not restricted to the described embodiment, but there can be many alternative embodiments within the scope of the invention defined by the patent claims. This applies among other things to the design of the receiver for determining the angle of roll.

What is claimed is:

1. A method for determining an angle of roll of a launchable body launched from a launching device, said launchable body rotating along a trajectory thereof, the method comprising:

essentially aligning a main pattern of a transmitter antenna arranged on the launching device with a main pattern of a receiver antenna coupled to a receiver arranged on the launchable body;

sweeping the main pattern of the transmitter antenna in a fixed plane relative to the launching device;

sweeping the main pattern of the receiver antenna in a fixed plane relative to the launchable body;

detecting a plurality of time intervals in which the main pattern of the transmitter antenna and the main pattern of the receiver antenna coincide;

recording a received signal strength during each of the plurality of time intervals;

creating a rotational envelope in the receiver using the recorded signal strengths; and determining the angle of roll of the launchable body using the rotational envelope and the plurality of time intervals.

2. The method of claim 1, wherein the launchable body comprises a rotating projectile.

3. The method of claim 1, wherein the launchable body comprises a shell.

4. The method of claim 1, wherein the launchable body comprises a guided missile.

5. The method of claim 1, further comprising using a difference in a time the main pattern of the transmitter antenna and the main pattern of the receiver antenna coincide, depending upon whether the main patterns are sweeping with each other or towards each other, to unambiguously determine the angle of roll for either of the angle intervals $0–\pi$ or $\pi–2\pi$.

6. The method of claim 1, further comprising determining the angle of roll within an angle interval from $0–\pi$ by an angle corresponding to a position on the rotational envelope.

7. The method of claim 1, further comprising:

measuring a time interval between two passes of the rotational envelope through zero;

determining a specific angle position between the two passes through zero by determining a proportion of time up to the specific angle position of the time between two passes through zero; and computing a corresponding proportion of $\pi$ using the determined proportion of time.

8. The method of claim 1, further comprising dimensioning the transmitter antenna and the receiver antenna to be operable within a millimeter wave range.

9. The method of claim 8, wherein the transmitter antenna and the receiver antenna are operable within a frequency range of 35–45 GHz.

10. The method of claim 1, further comprising:

sweeping the main pattern of the transmitter antenna in the fixed plane relative to the launching device in a first direction and turning off a transmitter coupled to the transmitter antenna during a subsequent return sweep in a second direction opposite to the first direction; and sweeping the main pattern of the receiver antenna in the fixed plane relative to the launchable body in a third direction and blanking an input to the receiver during a return sweep in a fourth direction opposite to the third direction.

11. The method of claim 1, wherein a sweep time of the main pattern of the receiver antenna is less than a sweep time of the main pattern of the transmitter antenna.

12. The method of claim 1, further comprising:

zeroing the main pattern of the receiver antenna with respect to the main pattern of the transmitter antenna at the moment of launching the launchable body;

measuring a time interval between an interception of the main pattern of the transmitter antenna with the receiver antenna's zeroed main pattern; and subsequently starting the sweep of the main pattern of the receiver antenna based on the time interval measurement, wherein the sweep of the main pattern of the receiver antenna is started so as to intercept the main pattern of the transmitter antenna at approximately 0 degrees.

13. The method of claim 1 wherein the main pattern of the transmitter antenna and the main pattern of the receiver antenna transmitter are each swept in a range of approximately ±5 degrees.

14. A system for determining an angle of roll of a launchable body launched from a launching device, said launchable body rotating along a trajectory thereof, the system comprising:

a transmitter having a transmitter antenna operatively connected to the launching device;

a receiver having a receiver antenna operatively connected to the launchable body;

means for sweeping a main pattern of the transmitter antenna along a fixed plane relative to the launching device;

means for sweeping a main pattern of the receiver antenna along a fixed plane relative to the launchable body; and within the receiver, means for processing received signal information relating to a plurality of associated time intervals and signal strengths received during times when the sweeping main pattern of the transmitter antenna and the sweeping main pattern of the receiver antenna coincide.

15. The system of claim 14, wherein the launchable body comprises a rotating projectile.

16. The system of claim 14, wherein the launchable body comprises a shell.

17. The system of claim 14, wherein the launchable body comprises a guided missile.

18. The system of claim 14, wherein the receiver comprises an envelope detector which creates a rotational envelope based on signal strengths recorded during the times the main patterns coincide.

19. The system of claim 14, wherein the receiver comprises a time measuring circuit.

20. The system of claim 14, wherein the receiver antenna comprises electrically controllable antenna elements in the form of dipole slots.

* * * * *